United States Patent [19]

Swartz et al.

[11] Patent Number: 4,550,798

[45] Date of Patent: Nov. 5, 1985

[54] ACOUSTIC PANEL AND ENCLOSURE

[75] Inventors: Henry D. Swartz, Chestnut Hill, Mass.; Alan H. Miller, Hickory, N.C.

[73] Assignee: Anechoic Systems Company, Inc., Westwood, Mass.

[21] Appl. No.: 688,649

[22] Filed: Jan. 4, 1985

[51] Int. Cl.[4] ..... B41J 29/08; E04B 1/82

[52] U.S. Cl. ..... 181/201; 181/286; 181/288; 181/290; 181/294

[58] Field of Search ..... 181/200, 201, 290–292, 181/288, 294, 286, DIG. 1

[56] References Cited

U.S. PATENT DOCUMENTS

| | | | |
|---|---|---|---|
| 3,747,735 | 7/1973 | Frick | 181/201 X |
| 4,167,598 | 9/1979 | Logan et al. | 181/290 X |
| 4,340,129 | 7/1982 | Salyers | 181/200 |
| 4,488,619 | 12/1984 | O'Neill | 181/290 |
| 4,496,024 | 1/1985 | Wolf et al. | 181/292 |

*Primary Examiner*—Benjamin R. Fuller

*Attorney, Agent, or Firm*—Jerry Cohen; Herbert L. Bello; M. Lawrence Oliverio

[57] ABSTRACT

An acoustic enclosure (10) has interconnected sound reducing panels forming a substantially rectangular structure which is configured to house a computer printer. Each side (12,14) panel is a multiple strata panel having an outer polymeric stratum (26), a multiple channel intermediate thermoplastic stratum (28) and an inner open celled acoustic material stratum (30). The rear and bottom panels (16, 18) are multiple stratum panels, having multiple channel intermediate thermoplastic stratum (46) which is sandwiched between inner and outer polyurethane foam strata (44,48). An adhesive material (42) is provided for bonding the outer stratum to the intermediate stratum and the intermediate stratum to the inner stratum for each of the panels. An angle member (62) affixed to the intermediate stratum is provided for joining adjacent panels of the enclosure. A rigid thermoplastic hinged cover (22) having a uniform bend (52) is provided for closing the enclosure.

13 Claims, 8 Drawing Figures

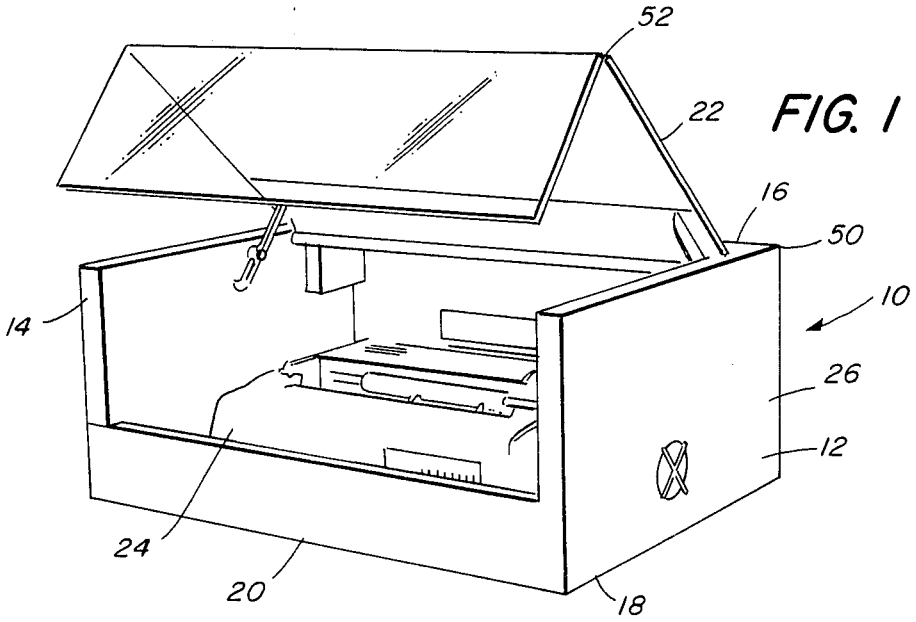
FIG. 1
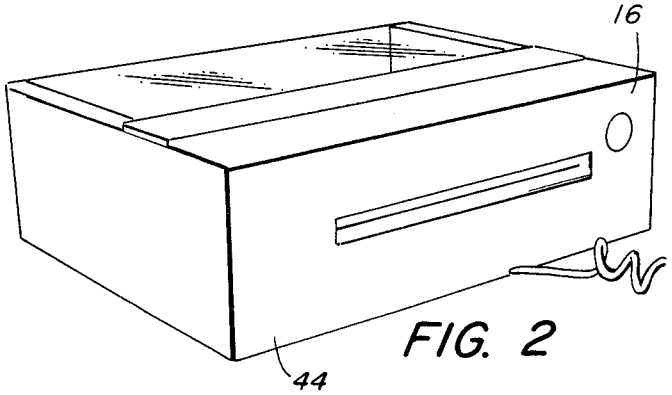
FIG. 2
FIG. 3
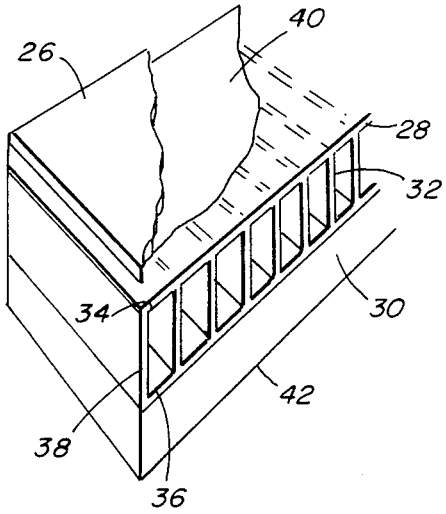
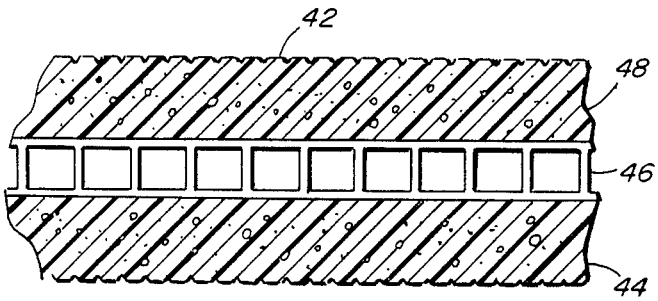
FIG. 4
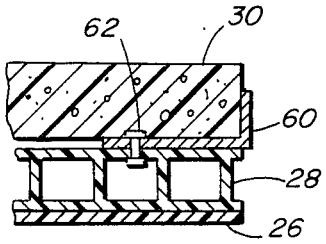
FIG. 5

ACOUSTIC PANEL AND ENCLOSURE

BACKGROUND OF THE INVENTION

1. Field of the Invention

The present invention relates to panels and enclosures, and, more particularly, is directed toward acoustic panels and acoustic enclosures.

2. Description of the Prior Art

Modular acoustic panel assemblies are well known for providing sound absorbing enclosures for noise making devices such as computer printers. Generally, manufacturers of such enclosures provide universal enclosures which have sound absorbing material on the interior walls. Due to the various printer configurations, each printer is characterized by unique noise frequencies as well as particular noise levels. Universal enclosures are not tailored to reduce specific noise frequencies associated with specific computer printers. Accordingly, when modifications are made to the enclosure to provide a paper feeding slot, for example, the sound absorbing properties of the enclosure decreases with a resulting increase in noise level. A need has arisen for an improved acoustic panel and enclosure for noise generating devices such as computer printers.

SUMMARY OF THE INVENTION

It is an object of the present invention to provide acoustic panels and enclosures which overcome the limitations and disadvantages of prior acoustic panels and enclosures.

It is a further object of the present invention to provide an acoustic panel which is effective in reducing noise, rigid in construction and aesthetically pleasing.

It is a further object of the present invention to provide a modular acoustic enclosure having a series of interconnected sound reducing panels forming a substantially rectangular structure which is configured to house a noise generating device such as a computer printer. Each side panel is a multiple layered multiple stratum assembly having an outer polymeric stratum, a thermoplastic multiple channel intermediate stratum and an inner open celled acoustic material stratum. The rear and bottom panels are multiple stratum panels, each panel having a thermoplastic multiple channel intermediate stratum which is sandwiched between inner and outer open celled acoustic material strata. The longitudinal axis of each channel of the intermediate stratum is disposed in a plane which is in space parallel relationship with the plane of the outer polymeric stratum. An adhesive material is provided to bond the outer stratum to the intermediate stratum and the intermediate stratum to the inner stratum for each of the panels. The outer, intermediate, and inner strata are superposed and held in fixed relationship to one another by the adhesive material. An angle member affixed to the intermediate stratum is provided for joining adjacent panels of the enclosure. The thickness of each acoustic material stratum is selected as a function of the level and frequency of the noise produced by the noise generating device housed within the enclosure.

The invention accordingly comprises the device, together with its parts, elements and interrelationships, that is exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in conjunction with the accompanying drawings, wherein:

FIG. 1 is a perspective view of an acoustic enclosure embodying the present invention;

FIG. 2 is a rear view of the acoustic enclosure of FIG. 1;

FIG. 3 is a perspective view, partly cut-away, of the side panel of the enclosure of FIG. 1;

FIG. 4 is a perspective view of the rear panel of the enclosure of FIG. 1;

FIG. 5 is a perspective view of the side panel of FIG. 1 having an angle member attached thereto.

DETAILED DESCRIPTION OF THE PREFERRED EMBODIMENTS

Figure 6A:
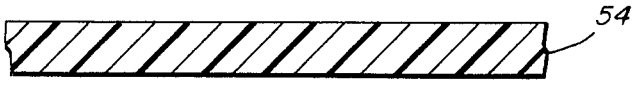
FIGS. 6A, 6B and 6C are schematic diagrams illustrating the steps of bending the thermoplastic cover of the enclosure of FIG. 1.

Referring now to the drawings, particularly FIGS. 1 and 2, there is shown an acoustic enclosure 10 embodying the present invention. Enclosure 10 includes side panels 12, 14, a rear panel 16, a bottom panel 18, a front panel 20, and a cover 22. A noise generating device 24, for example a computer printer, is mounted within enclosure 10. The construction details of side panels 12 and 14 are shown in FIG. 3, and the construction details of rear panel 16 and bottom panel 18 are shown in FIG. 4.

Referring now to FIG. 3, it will be seen that each side panel 12 and 14 includes an outer polymeric stratum 26, a multiple channel thermoplastic intermediate stratum 28, and an open celled acoustic material inner stratum 30. Outer polymeric stratum 26 is composed of a rigid or flexible material that has aesthetically attractive finish on its outer or exposed face, for example a laminated plastic sheet such as that sold under the trademark FORMICA. Intermediate stratum 28 is composed of an extruded thermoplastic of the rigid type, for example a polycarbonate, having an outer sheet 34, an inner sheet 36 and interior sidewalls 38 which form a plurality of linear internal chambers or channels 32. In the illustrated embodiment, outer sheet 34 and inner sheet 36 are in spaced parallel relationship to one another and chamber sidewalls 38 are in perpendicular relationship to the outer and inner sheets 34, 36, linear channels 32 having a substantially rectangular profile in right cross section. The longitudinal axis of each channel 32 is in spaced parallel relationship to one another and lie in a plane which is in spaced parallel relationship with the plane in which outer polymeric stratum 26 lies. In alternative embodiments, channels 32 are other than rectangular shaped channels, for example triangular or sign wave shape channels. However, in any alternative embodiment, the longitudinal axis of each channel 32 lies in a plane which is parallel to the plane in which outer stratum 26 lies. The bending strength of side panel 12 resulting from the combination of polymeric outer stratum 26 and multiple channel intermediate stratum 28 is twice the bending strength of the intermediate panel alone. In alternative embodiments, intermediate stratum is composed of a material other than a polycarbonate, for example, a high density polyethylene, polystyrene, polypropylene, single or multi-walled corrugated paperboard. The outer side of intermediate stratum 28 and outer stratum 26 are affixed to one another by a suitable adhesive 40. Inner stratum 30 is composed of an open celled acoustic material such as polyurethane foam or vinyl foam. Inner stratum 30 is attached to outer side of inner sheet 36 by a suitable adhesive 40. In the illustrated embodiment, by way of example, the inner or exposed surface of inner stratum 30 is provided with a plurality of peaks and valleys which define a textured surface 42 with an expanded surface area for greater sound absorption. In an alternative embodiment, the exposed surface of inner stratum 30 is generally smooth.

Rear panel 16 and bottom panel 18, shown in FIG. 4, include an outer polyurethane foam strata 44 composed of an open celled acoustic material, an intermediate stratum 46 composed of a thermoplastic, and an inner polyurethane foam stratum 48 composed of an open celled acoustic material. Intermediate strata 46 is sandwiched between inner and outer strata 44, 48 and held in position by adhesive 40. Inner and outer strata 44 and 48 are composed of the same material as inner stratum 30 and intermediate stratum 46 is composed of the same material as intermediate stratum 28.

Figure 6B:
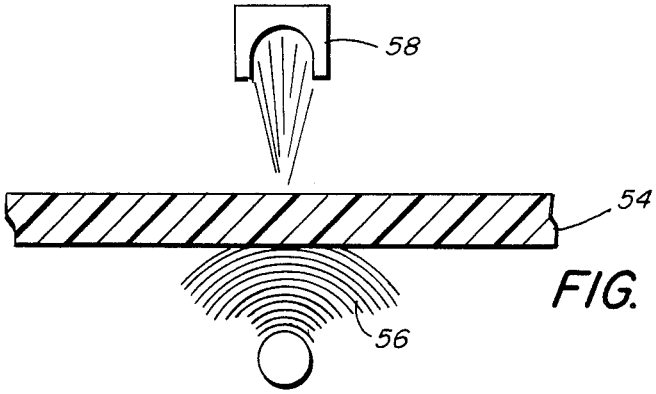
Figure 6C:
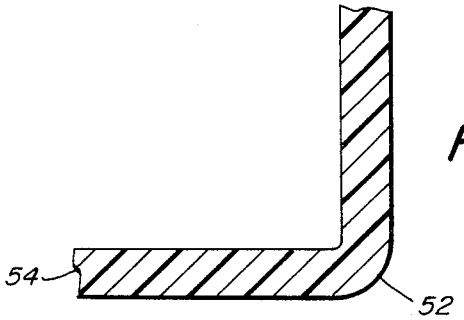

Front panel 20 is similar in construction to side panels 12 and 14. Cover 22, for example an optically clear rigid thermoplastic sheet, composed of an acrylic or polycarbonate for example, is hinged to a top shelf 50 which is attached to the rear of enclosure 10. Top shelf 50 is similar in construction to front panel 20. Cover 22 is provided with a bend 52 which is formed in a novel manner according to the steps shown in FIG. 6A through FIG. 6C. In FIG. 6B, heat 56 is applied to a wide area on the outer surface of the sheet 54 at the inner area where the bend 52 is to be made. The heat applied to this relatively large area is sufficient to raise the temperature at a depth of less than fifty percent of the thickness of the sheet to the plasticized state temperature. After a time delay of approximately thirty to ninety seconds, a focused beam of heat 58 is applied to the inner surface of the sheet 54 where bend 52 is to occur for approximately thirty seconds to raise the temperature of the entire thickness of the sheet to the plasticized state temperature. The width of the focused band of heat is twice the thickness of sheet 54 and the width of the broad band of heat is four times the thickness of the sheet. Thereafter, as shown in FIG. 6C, thermoplastic material 54 is bent at 52.

Referring now to FIG. 5, there is shown a side panel which is provided with an angle member bracket 60, for example a right angle bracket, for mounting adjacent panels. Angle bracket 60, which is composed of a material or synthetic material such as wood, aluminum or plastic, is affixed to intermediate strata 32 and 46 between the inner strata 30 and 42, respectively. In the preferred embodiment, angle bracket 60 is affixed to in the second or third chamber from the edge of intermediate strata 28 and 46 by rivets 62 by a thermal or chemical bonding. As shown in FIG. 1, outer strata 26 of selected ones of the panels extend beyond angle bracket 60 so that the angle bracket is not visible when the enclosure 10 is fabricated.

In order to maximize the sound absorbing characteristics of enclosure 10, selected thicknesses of the open celled acoustic material, for example polyurethane foam, which is provided on inner strata 30 of side panels 12 and 14, front panel 20 and shelf 50, on inner stratum 44 of rear panel 16, and on outer stratum 48 of bottom panel 18 are applied to minimize noise and vibration generated by computer printer 24. That is, the noise generated by computer printer 24 which is positioned within enclosure 10 and the enclosure is tuned for minimimum noise generation by placing various thicknesses of the polyurethane foam at selected places. Sound measurements are taken at various locations about the enclosure 10 and additional thickness of polyurethane foam are added until the measured noise level is below acceptable levels, for example 60 db. After this initial tuning of enclosure 10, complete sheets of polyurethane foam corresponding to the maximum thickness of the polyurethane foam positioned during the tuning process is then affixed to the side panels 12, 14, rear panel 16, bottom panel 18, front panel 20 and top shelf 50. The thickness of the intermediate strata 28 and 46 is in the range of 2 mm to 40 mm. As noted in FIGS. 1 and 2, enclosure 10 is provided with openings for air circulation, power cords, paper feed slots and the like.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. An acoustic panel comprising:

(a) a polymeric outer stratum;

(b) a thermoplastic intermediate stratum having inner and outer sheets disposed parallel to one another and a plurality of interior walls forming a plurality of internal chambers between said inner and outer sheets, the longitudinal axis of each said internal chamber lying in a plane which is in spaced parallel relationship to the plane in which the polymeric outer stratum lies; and (c) an inner stratum composed of an open celled acoustic material;

(d) said outer sheet of said intermediate stratum attached to said attached polymeric outer stratum and said inner sheet of said intermediate stratum attached to said open celled acoustic material inner stratum.

2. The acoustic panel as claimed in claim 1 wherein said thermoplastic inner stratum is composed of polycarbonate.

3. The acoustic panel as claimed in claim 2 wherein said open celled acoustic outer stratum is composed of polyurethane foam.

4. The acoustic panel as claimed in claim 3 wherein each said channel has a substantially rectangular profile in right cross section.

5. The acoustic panel claimed in claim 4 wherein said polymeric outer stratum is a laminated plastic sheet having a finished outer surface.

6. The acoustic panel as claimed in claim 1 wherein the thickness of said intermediate stratum is in the range of 2 mm to 40 mm.

7. The acoustic panel as claimed in claim 6 wherein the inner exposed surface of said inner stratum is textured to provide an increase surface area per square foot.

8. An acoustic enclosure comprising:

(a) a pair of side panels, each said side panel including a polymeric outer stratum, a thermoplastic intermediate stratum having inner and outer sheets disposed parallel to one another and a plurality of interior walls forming a plurality of internal chambers between said inner and outer sheets, the longitudinal axis of each said internal chamber lying in a plane which is in spaced parallel relationship to the plane in which the polymeric outer stratum lies, and an inner stratum composed of an open celled acoustic material, said outer, intermediate, and inner strata superposed on one another and fixed to one another;

(b) a rear panel having an open celled acoustic material outer stratum, a thermoplastic intermediate stratum and an open celled acoustic material inner stratum, said strata of said rear panel being superposed on one another and in a fixed relationship to one another;

(c) a bottom panel having an inner stratum composed of an open celled acoustic material, an intermediate stratum composed of a thermoplastic material and an outer stratum composed of an open celled acoustic material, said strata of said bottom panel being superposed on one another and in a fixed relationship to one another;

(d) said side panels, said rear panel and said bottom panel attached to one another to form an enclosure having an opening at the top and front; and (e) a cover hinged to said enclosure, said cover moveable between an open position and a closed position, said enclosure being closed when said cover is in said closed position and opened when said cover is in said open position.

9. The acoustic enclosure as claimed in claim 8 wherein said polymeric outer stratum is a laminated plastic sheet, said intermediate thermoplastic sheet is composed of polycarbonate, and said outer stratum is composed of polyurethane foam.

10. The acoustic enclosure as claimed in claim 8 wherein each said internal chamber has a substantially rectangular profile in right cross section.

11. The acoustic enclosure as claimed in claim 8 wherein the thickness of said intermediate stratum is in the range of 2 mm to 40 mm.

12. The acoustic enclosure as claimed in claim 8 including an angle member attached to said intermediate stratum of said side, rear and bottom panels for joining said panels to one another to form said enclosure.

13. An acoustic panel comprising:

(a) an outer stratum composed of an open celled acoustic material;

(b) a thermoplastic intermediate stratum having inner and outer sheets disposed parallel to one another and a plurality of interior walls forming a plurality of internal chambers between said inner and outer sheets, the longitudinal axis of each said internal chamber lying in a plane which is in spaced parallel relationship to the plane in which the outer stratum lies; and (c) an inner stratum composed of an open celled acoustic material;

(d) said outer sheet of said intermediate stratum superposed and attached to said open celled acoustic material outer stratum and said inner sheet of said intermediate stratum superposed and attached to said open celled acoustic material inner stratum.

* * * * *